United States Patent [19]

Maas

[11] Patent Number: 4,883,227

[45] **Date of Patent: * Nov. 28, 1989**

[54] FOAMER NOZZLE ASSEMBLY WITH AIR PASSAGEWAY

[75] Inventor: Joseph W. J. Maas, Someren, Netherlands

[73] Assignee: AFA Products, Inc., Forest City, N.C.

[ * ] Notice: The portion of the term of this patent subsequent to Mar. 15, 2005 has been disclaimed.

[21] Appl. No.: 158,329

[22] Filed: Feb. 19, 1988

Related U.S. Application Data

[63] Continuation of Ser. No. 817,935, Jan. 10, 1986, Pat. No. 4,730,775.

[51] Int. Cl.[4] ..... B05B 1/02; B05B 1/12; B05B 7/04

[52] U.S. Cl. ..... 239/120; 239/289; 239/333; 239/343; 239/391; 239/428.5; 239/436; 239/493; 239/600

[58] Field of Search ..... 239/120, 311, 312, 333, 239/343, 391, 428.5, 419.5, 432, 436, 483, 493, 600, 289

[56] References Cited

U.S. PATENT DOCUMENTS

| | | | |
|---|---|---|---|
| 654,891 | 7/1900 | Haley | 239/590.5 |
| 1,082,130 | 12/1913 | McCallen | 239/432 |
| 1,595,650 | 8/1926 | Edenharder et al. | 239/391 |
| 2,766,026 | 10/1956 | Boyd | 239/428.5 |
| 2,826,399 | 3/1958 | Eriksson | 261/76 |
| 3,693,884 | 9/1972 | Snodgrass et al. | 239/428.5 |
| 3,946,947 | 3/1976 | Schneider | 239/311 |
| 4,071,195 | 1/1978 | Kuhns et al. | 239/436 |
| 4,219,159 | 8/1980 | Wesner | 239/428.5 |
| 4,330,086 | 5/1982 | Nysted | 239/428.5 |
| 4,350,298 | 9/1982 | Tada | 239/333 |
| 4,463,905 | 8/1984 | Stoesser et al. | 239/428.5 |
| 4,598,862 | 7/1986 | Rice | 239/8 |
| 4,767,060 | 8/1988 | Shay et al. | 239/428.5 |

FOREIGN PATENT DOCUMENTS

| | | | |
|---|---|---|---|
| 256639 | 2/1988 | European Pat. Off. | 239/333 |
| 56-129850 | 2/1981 | Japan . | |
| 18515 | of 1908 | United Kingdom | 239/397 |

*Primary Examiner*—Andres Kashnikow
*Assistant Examiner*—Michael J. Forman
*Attorney, Agent, or Firm*—Thomas R. Vigil

[57] ABSTRACT

The two piece foamer nozzle assembly comprises a first piece including a body having a front end and a rear end and a second piece releasably connected to the first piece. The first piece has a first cavity in the body thereof opening onto the rear end thereof and being adapted to be received over a nozzle bushing mounted at the front end of the body of a hand manipulatable pumping apparatus. The nozzle bushing is of the type which will eject fluid into the first cavity in a swirl or spiral manner. The first piece further comprises a barrel portion having a second cavity opening onto the front end thereof and an intermediate wall within the first piece between the first and second cavities. The intermediate wall has an orifice extending therethrough with a rear end communicating thereof with the first cavity and a front end communicating with the second cavity. The swirl of liquid is ejected in a spray pattern from the front end of the orifice. The second piece has a rearwardly extending formation sized to be releasably received and fixed within the second cavity of the first piece. The formation has a foam generating chamber therein which opens onto the rear end of the second piece in front of the front end of the orifice and which has an irregular surface therein. The second piece also has a front end with a nozzle opening therein and the foam generating chamber is in communication with the nozzle opening whereby liquid sprayed in a generally conical pattern into the foam generating chamber and impinging upon the irregular surface mixes with air and creates foam which is ejected through the nozzle opening.

9 Claims, 5 Drawing Sheets

FOAMER NOZZLE ASSEMBLY WITH AIR PASSAGEWAY

This is a continuation of application Ser. No. 817,935, filed Jan. 10, 1986, now U.S. Pat. No. 4,730,775, issued Mar. 15, 1988.

BACKGROUND OF THE INVENTION

1. Field of the Invention

The present invention relates to a two piece foamer nozzle assembly which is adapted to be mounted on a nozzle bushing mounted at the forward end of the body of a trigger sprayer. More specifically, the present invention relates to a two piece nozzle assembly including first and second pieces which are constructed, configured and arranged so as to be able to generate foam for fluids having different viscosities and which includes a second outer piece that is detachable and can be clipped onto the bottom of the first piece to enable a spray pattern to be emitted from the first piece.

2. Description of the Prior Art

Heretofore various constructions have been proposed for a foam generating nozzle which is integral with the spraying device or which is attachable thereto. Examples of such previously proposed foam generating devices and nozzles are set forth in the following U.S. patents:

| U.S. PAT. NO. | PATENTEE |
|---|---|
| 3,946,947 | Schneider |
| 4,013,228 | Schneider |
| 4,219,159 | Wesner |
| 4,350,298 | Tada |
| Des 242,327 | Schneider |

Also, heretofore various foaming apparatus and nozzles have been proposed in published Japanese utility model applications which are set forth below:

| Publication Number | Publication Date | Applicant |
|---|---|---|
| 58310 | 1975 | Maruyama Seisakusho |
| 129850 | 10/2/81 | Yoshino Kogyosho |
| 133358 | 10/9/81 | Yoshino Kogyosho |
| 193551 | 12/22/84 | Yoshino Kogyosho |
| 193549 | 12/22/84 | Yoshino Kogyosho |
| 193550 | 12/22/84 | Yoshino Kogyosho |

Also, reference is made to the Canyon Corporation Japanese Published Patent Application No. 57-192076, Publication No. 82964, published on May 14, 1984.

The Schneider U.S. Pat. Nos. 3,946,947, Des. 242,327 and 4,013,228 disclose elongate barrels into which a spray of liquid is ejected whereby foam can be created in the barrel.

U.S. Pat. No. 4,219,159 discloses a foam device for attachment to a trigger sprayer which includes a barrel with two screens mounted therein.

U.S. Pat. No. 4,350,298 discloses in FIG. 6 thereof a movable nozzle cap assembly in which foam is generated.

Japanese UM Publication No. 58310 discloses a foaming apparatus which includes a foaming pipe having openings therein for facilitating the generation of foam within the outer end portion of the foaming pipe.

The Japanese Utility Model Publication Nos. 129850, 137463, 193551, 193549 and 193550 disclose nozzle assemblies, each having a portion which can be moved outwardly to form a chamber in which foam can be generated and then ejected from the nozzle assembly.

Japanese Published Patent Application, Publication No. 82964 discloses a three position nozzle assembly having a FOAM, SPRAY and OFF position.

Japanese Utility Model Publication No. 13358 discloses a nozzle assembly including a nozzle cap having a foam ejection cylinder with openings therein for generating foam.

As will be described in greater detail hereinafter, the foam generating nozzle assembly of the present invention can include a nozzle bushing mounted on the end of the body of a trigger sprayer, a first inner piece of a nozzle foamer assembly adapted to be mounted on the nozzle bushing and a second outer piece adapted to be mounted to the first piece and having an internal barrel configuration which is configured, constructed and arranged to facilitate the generation of foam from liquid sprayed thereinto for liquids having different viscosities.

The foam generating nozzle assembly of the present invention also can be constructed, configured and arranged so that the second outer piece can be detached from the first piece to permit a spray pattern to be emitted from the first piece while the second piece is detachably clipped to the underside of the first piece. Also, the second outer piece can be constructed, configured and arranged so that air enters a foaming chamber completely around a generally cylindrical entrance to the foaming chamber. Furthermore, the second piece can be constructed, configured and arranged to prevent dripping of foam by providing for the eduction of excess foam back into the two piece foamer nozzle assembly on trigger strokes of the sprayer.

According to the invention there is provided a trigger sprayer having a mounting formation at a front end thereof from which liquid is ejected and comprising a foam generating nozzle assembly including structure having an orifice and a foam generating chamber therein, said nozzle assembly structure being mounted on the formation at the front end of said trigger sprayer so that liquid is emitted from the formation at the front end of the trigger sprayer through said orifice into said foam generating chamber in a generally conical spray pattern, said foam generating chamber having an entrance end into which said spray is directed, and said nozzle assembly also including a front nozzle member having a discharge opening at a front end thereof from which foam is discharged, said discharge opening being in communication with said foam generating chamber whereby foam is ejected forwardly from said foam generating chamber, and having an enclosed air passageway having a first end and a second end, said first end communicating with said air passage means and said second end opening adjacent said front end of said front nozzle member and adjacent said discharge opening at said front end of said front nozzle member.

DESCRIPTION OF THE PREFERRED EMBODIMENT

Figure 1:
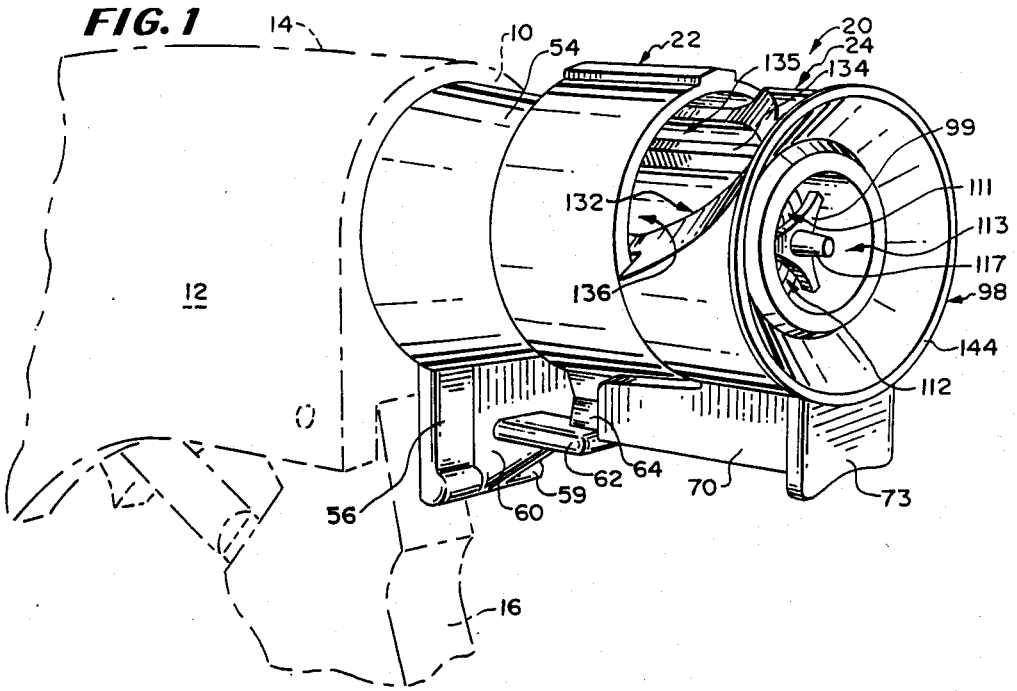
FIG. 1 is a perspective view of the two piece foamer nozzle assembly of the present invention.

Referring now to FIG. 1, there is illustrated in phantom therein, the forward end portion 10 of a body 12 of a trigger sprayer 14. Also partially shown in phantom, is a portion of a trigger 16 depending from the forward end portion 10 of the body 12 of the trigger sprayer 14.

Mounted to the forward end portion 10 is a two piece nozzle foamer assembly 20 constructed in accordance with the teachings of the present invention.

This two piece nozzle foamer assembly 20 comprises a first inner piece 22 and a second outer piece 24.

Figure 2:
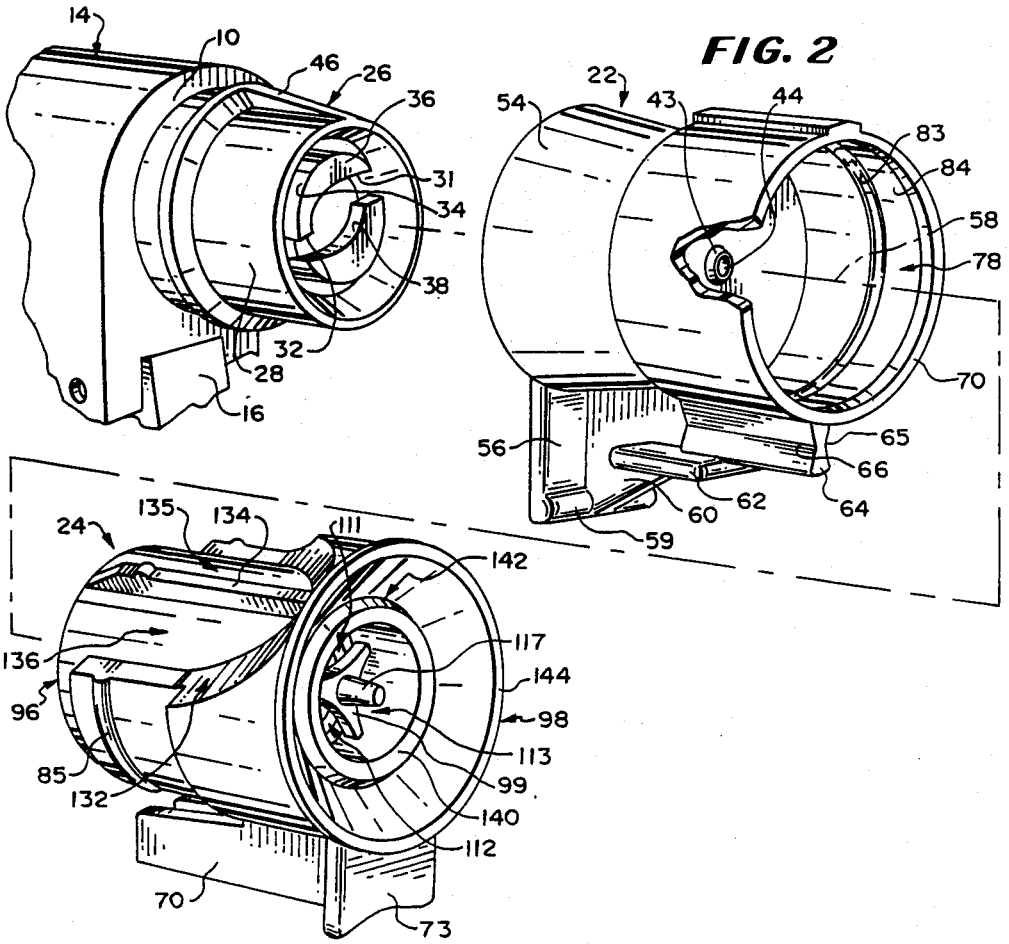
FIG. 2 is an exploded perspective view of the two piece foamer nozzle assembly shown in FIG. 1 and shows a nose bushing mounted on the body of the trigger sprayer to which the nozzle assembly is attached, a first or inner piece of the nozzle assembly and a second or outer piece of the nozzle assembly.
Figure 3:
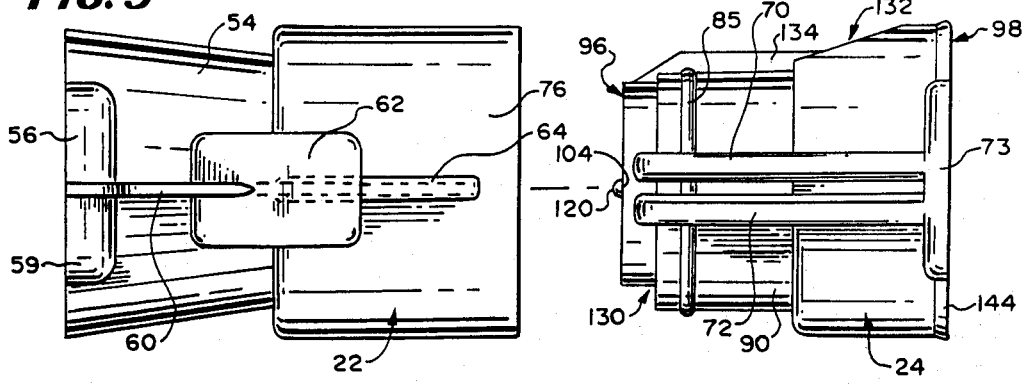
FIG. 3 is a bottom plan view of the two piece nozzle assembly shown in FIG. 1 with the two pieces separated as shown in FIG. 2.
Figure 4:
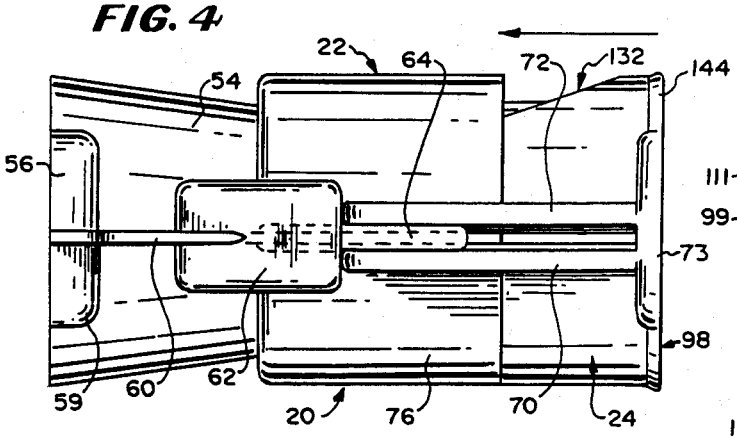
FIG. 4 is a bottom plan view of the two piece nozzle assembly and is similar to FIG. 3, but with the two pieces brought together.

As best shown in FIG. 2, the first inner piece 22 is mounted on a nozzle bushing 26 which is mounted to the body end portion 10 and which is generally of conventional known design.

The nozzle bushing 26 includes a body portion 27 (FIG. 10) which is mounted within the trigger sprayer body end portion 10. Such body portion 27 of the bushing 26 is generally cylindrical and has a formation therein (not shown) for establishing a flow path for liquid to an outer nose portion 28 of the bushing 26.

Two tangentially extending slots 31 and 32 extend in the front face of a generally cylindrical base 36 from an outer cylindrical surface 34 of the cylindrical boss 36 to a tangent of a generally cylindrical cavity 38 in the front face of the boss 36. The slots 31 and 32 communicate with a radially outer entrance to each of the slots 31 and 32 in an annular groove 40 which communicates with a passageway 42 in the body 27 so that liquid under pressure can be forced into the cylindrical cavity 38 in a tangential or swirl pattern so that as liquid moves axially forward from the cylindrical cavity 38 into the first piece 22 of the foamer nozzle assembly 20, such liquid will be swirling so as to exit the front end 43 of an orifice 44 in the first piece 22 in a swirl or spray pattern.

It will be noted that the nose portion 28 of the bushing 26 is generally cylindrical in shape and has a rib 46 on an upwardly facing portion thereof. The rib 46 forms a stop which will cooperate with ribs 51 and 52 (FIG. 7) within a cowling 54 of the first piece 22. In this respect, the rib 51 in the cowling 54 will engage the rib 46 on the nose portion 28 of the bushing 26 when the foamer assembly 20 is in an OFF position and the rib 46 on the nose portion 28 of the bushing 26 will engage the rib 52 when the foamer nozzle assembly 20 has been rotated approximately 120° (FIG. 6) to a FOAM (or SPRAY) position.

Cylindrical boss 36 with at least two tangential slots 31 and 32 extending in the front face of the boss 36 from an outer entry area, outer cylindrical surface 34, to an inner cylindrical cavity 38 is similar to the structure disclosed and claimed in U.S. Pat. No. 4,234,128, the disclosure of which is incorporated herein by reference.

Figure 5:
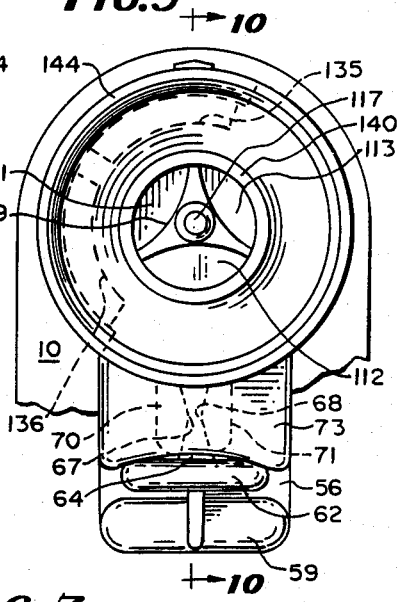
FIG. 5 is a front end view of the two piece nozzle assembly of the present invention in the OFF position.

The first piece 22 will now be described with reference to FIGS. 2, 3, 7 and 9. As shown in FIG. 2, the cowling 54 has a flange 56 extending downwardly generally perpendicular to the axis 58 of the orifice 44 and this flange 56 has a rib 59 at the lower end thereof extending transversely of the first piece 22. From this flange 56, another flange 60 extends forwardly, generally coplanar with the axis 58 of the orifice 44 and generally radially outwardly from the axis 58 of the orifice 44. This second flange 60 provides a gripping structure which can be gripped with a finger or thumb for rotating the first piece 22 from a closed position shown in FIG. 5 to a spray or foam position shown in FIG. 6.

Figure 14:
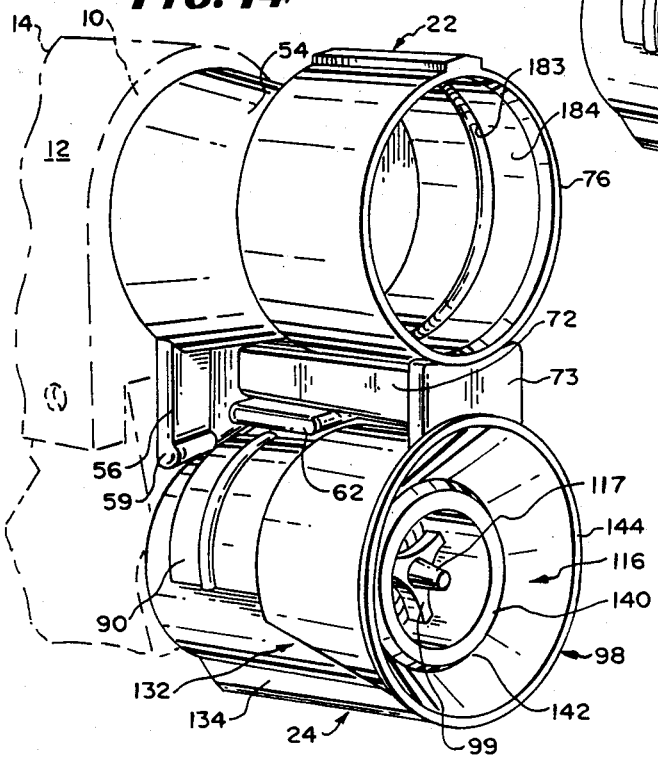
FIG. 14 is a perspective view of the outer second piece attached to and depending from the first inner piece.

Extending transversely outwardly from each side of the flange 60 and forwardly of this flange 60 is a land or ledge 62 which prevents disengagement of the second piece 24 from the first piece 22 when the second piece 24 is connected thereto in a depending manner as shown in FIG. 14.

Figure 6:
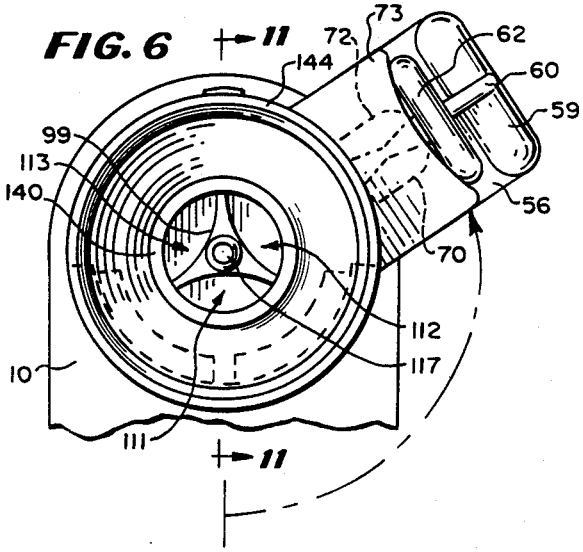
FIG. 6 is a front plan view of the two piece nozzle assembly of the present invention in the FOAM position where the assembly has been rotated 120°.
Figure 7:
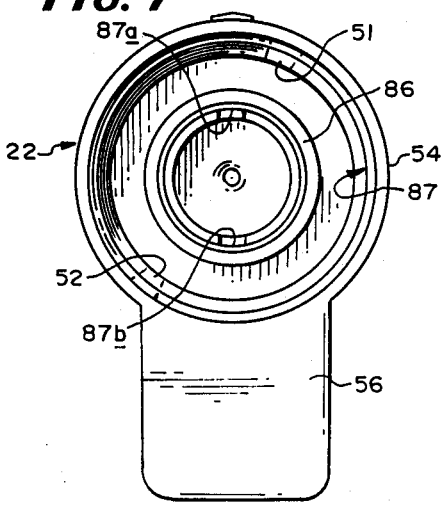
FIG. 7 is a back end view of the two piece nozzle assembly of the present invention.
Figure 8:
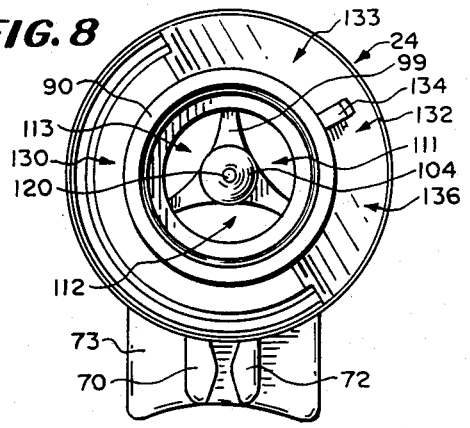
FIG. 8 is a back end view of the second outer piece.

Then, extending forwardly from the forward end of the forwardly extending flange 60 and above a portion of the ledge 62 is a rib 64 which has a generally X-shaped cross-section as shown in FIG. 6 so as to have grooves 65 and 66 on each side thereof for receiving thereover mating ribs 67 and 68 on locking fingers 70 and 72 which extend axially, rearwardly from a tab 73 that extends radially outwardly from the second piece 24. The fingers 70 and 72 and the rib 64 form a "tongue and groove formation" whereby movement of the fingers 70 and 72 transversely of the rib 64 is inhibited by the rib 67, 68 and groove 65, 66 engagement.

Figure 9:
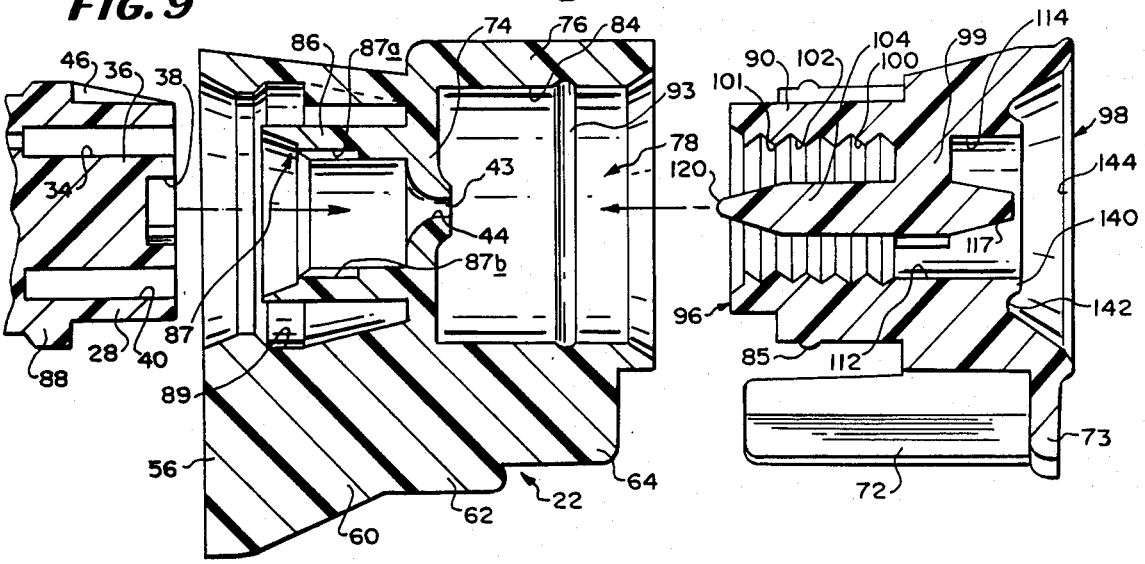
FIG. 9 is a vertical sectional view of the nozzle assembly shown in FIG. 2 with the parts of the assembly separated from each other.

The first piece 22 has an internal wall 74 (FIGS. 2, 9 and 10) therein through which the orifice 44 extends and a barrel portion 76 extends forwardly from the wall 74 which separates the cowling 54 from the barrel portion 76. The rib 64 is integral with the barrel portion 76 and is located on an underside thereof as shown in FIGS. 2 and 9.

The barrel portion 76 has a generally cylindrical cavity 78 therein, the inner end portion 80 of which forms an entrance area 80 to a foam generating chamber 82 in the second piece 24 which will be described in greater detail hereinafter.

Figure 10:
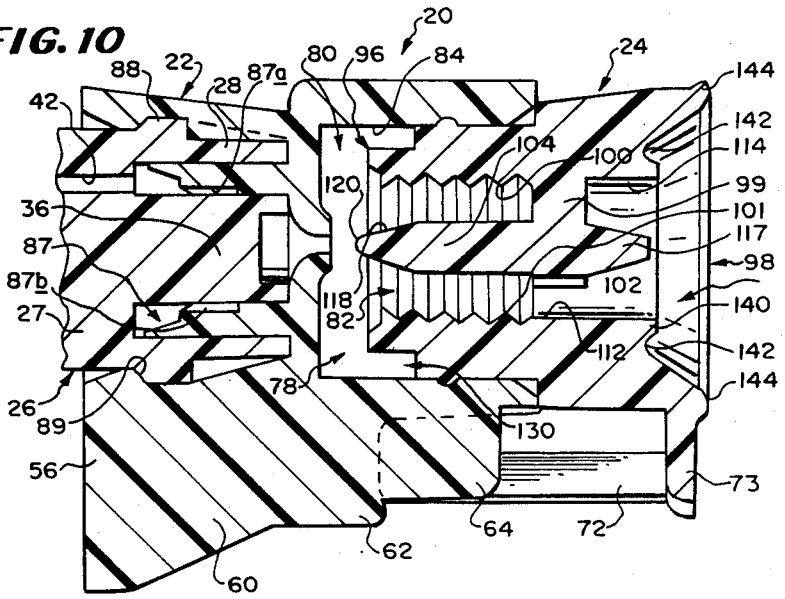
FIG. 10 is a vertical sectional view similar to the view shown in FIG. 9 but shows the pieces of the assembly assembled and is taken along line 10—10 of FIG. 5.

The cylindrical wall surface 84 of the cavity 78 has an annular groove 83 therein that is adapted to receive a locating and locking annular rib 85 on a cylindrical formation 90 of the second outer piece 24 which is adapted to be received within the barrel portion 76 of the first piece 22 as shown in FIG. 10 and which has the foam generating chamber 82 therein. The interengagement of the rib 85 in the groove 83 serves to releasably, axially, fix the pieces 22 and 24 together while the interengagement of the fingers 70 and 72 with the rib 64 prevents relative rotation between pieces 22 and 24. If desired, the second piece 24 can be permanently fixed, by spin welding, solvent bonding ultrasonic welding, adhesive, etc. to the first piece 22 the rib 85, the groove 83, the tab 73, the fingers 70, 72 and the rib 64 then can be omitted.

Within the cowling 54 and extending rearwardly from the middle wall 74 is an annular formation 86 which is adapted to be received over the cylindrical boss 36 of the bushing 26 and within the annular groove 40 in the bushing 26. This annular formation 86 has a stepped or countersunk formation 87 having channels 87*a* and 87*b* which provide a passage for liquid from the passageway 42 to the slots 31 and 32.

Still referring to FIGS. 9 and 10, it will be appreciated that the bushing 26 has an annular shoulder 88 and that this annular shoulder is snap-fittingly received within an annular space or slot 89 formed within the interior of the cowling 54 so that the cowling 54 is snap-fittingly received on and over the bushing 26.

When the bushing 26 is mounted in the cowling 54, the cylindrical boss 36 with the cylindrical cavity 38 therein abuts the wall 74 adjacent a rear flared end 94 of the orifice 44 which flares outwardly rearwardly from the forward end 43 of the orifice 44. This flared entrance end 94 facilitates the flow of swirling liquid from the cylindrical cavity 38 into and through the orifice 44 and out the exit end 43 of the orifice 44 into the foam generating chamber 82 within the cylindrical formation 90 of the second piece 24 which is received in the cavity 78 in barrel portion 76 of the first piece 22.

In accordance with the teachings of the present invention, the foam generating chamber 82 extends into the second piece from a rear end 96 thereof toward a front end 98 of the second piece 24 and has an irregular rough surface 100 which is shown in FIGS. 9 and 10 as being a serrated surface 100 defined by alternating (undulating) annular ribs 101 and annular grooves 102. A deflecting pin 104 extends rearwardly from the internal wall 99 within the chamber 82 as shown.

This internal wall 99 is Y-shaped so as to provide three passageways 111, 112 and 113 about the pin 104. These passageways allow foam to escape from the chamber 82 into a cylindrical foam accumulating chamber 114 and then into a larger-in-diameter outwardly flaring or frustoconical nozzle opening 116 in the front end 98 of the second piece 24. To facilitate the "coming together" of the stream of foam exiting the passageways 111, 112 and 113 into the chamber 114, a slightly conically shaped pip or pin 117 is integral with and extends forwardly from the wall 99 into the chamber 114. Tests have shown that the pip or pin 117 acts as a guide means for the streams of foam passing through the passageways 111, 112, 113 and brings the streams together.

The pin 104 has a frustoconical end portion 118 and a rounded end 120 which provide deflecting surfaces for spray or droplets that come straight out of the front end 43 of the orifice 44. The rounded end 120 of the pin 104 adjacent the front end 43 of the orifice 44 has a radius between 0 and 30 mm and preferably 0.8 mm. Also, the thickness of the pin can be between 0.14 and 0.63 times the diameter of the chamber 82 and is preferably approximately 0.42 times the diameter of the chamber 82. The angle of the conical surface 118 of the pin 104 can be between 5 degrees and 85 degrees relative to the axis of the pin 104 and is preferably 14 degrees on one side of the conical surface 118 to a horizontal plane. Also, the distance between the rounded end 120 of the pin 104 and the front end 95 of the orifice 44 can be between −1.6 mm (extending into the orifice 44) and 4 mm and preferably is 1.2 mm.

The Y-shaped wall 99 serves primarily for mounting the pin 104 which deflects any droplets that exit the front end 43 of the orifice 44 generally forwardly rather than in an outward spray.

The serrated surface 100 of ribs 101 and grooves 102 provides an irregular surface which causes breaking up and mixing of the droplets with air to create foam. It has been found that this structure will create foam from low surfactant (viscosity) type liquids such as window cleaners, to high surfactant (viscoity) type liquids such as oven degreasing cleaners.

As shown, the rear end 96 of the second piece 24 is stepped so as to have an annular area 130 which has a smaller diameter than the bulk of the cylindrical formation 90 to provide air passage means into the foam generating chamber 82 completely around the entrance end to the chamber 82 in the entrance area 80.

Figure 11:
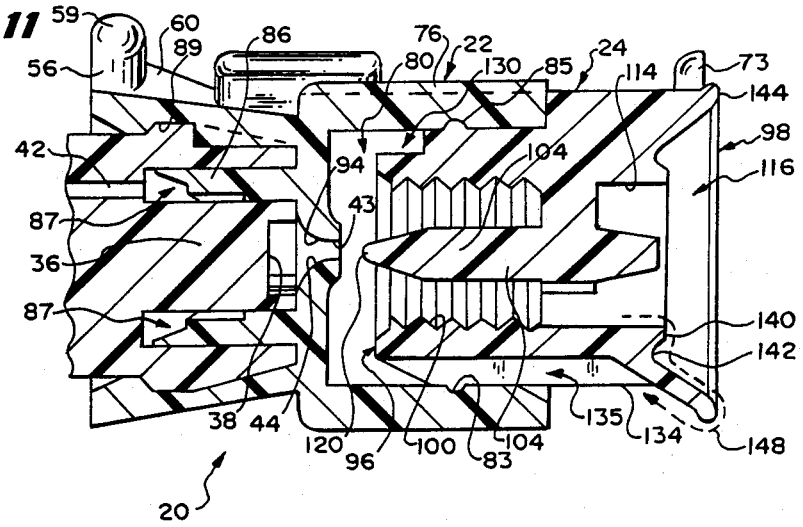
FIG. 11 is a vertical sectional view of the assembly after it has been rotated to the position shown in FIG. 6 and is taken along line 11—11 of FIG. 6.

Referring now to FIGS. 1 and 11, it will be apparent that a portion of the cylindrical formation is cut away or dished out at 132 to the diameter of the cylindrical formation 90. Then, a rib 134 extends axially along and is integral with the cylindrical formation and the dished out portion 132 so that two air slots 135 and 136 are formed on either side of the rib 134 for communicating air from outside of the barrel portion 76 of the first piece 22 through the two air entry slots 135 and 136 to the annular area on space 130. In this way, air will be sucked in from the annular space 130 about the annular formation 90 and into the entrance area 80 to and into the serrated foam generating chamber 82, 360° around the chamber 82 so that good and complete mixing of air with the droplets to create foam is achieved.

The foam created or generated in the chamber 82 then exits through the three openings 111–113 formed in the Y-shaped wall 99 and into the expansion and accumulating chamber 114 along the pip or pin 117 where the foam accumulates and then flows out the nozzle opening 116 in a cohesive mass rather than in three streams, which could occur if the foam came directly out of the three openings 111–113 in the Y-shaped wall 99.

As shown in FIG. 11, air flows in through the slot 135 into the entrance area 80 and then into the foaming chamber 82.

In use, on a squeeze of the trigger 16, liquid is caused to spray out of the outer end 43 of the orifice 44 and any large droplets or misdirected droplets which go straight will hit the rounded end 120 of the pin 104 or the tapered side surface 118 and be deflected into the foam generating chamber 82 against the uneven irregular surface 100 which in this embodiment is the serrated surface 100 comprising the alternating ribs 101 and grooves 102.

Then the foam will be ejected from the accumulating chamber 114 and the flared nozzle opening 116 against the surface to which it is to be applied. Any foam that may drain out of the accumulating chamber 114 over an annular ridge 140 and into the nozzle opening 116 will first be received in an annular groove 142 in the nozzle opening 116 and then will flow out to and about an outer rim 144 defining the outer end of the opening 116.

Then, on the next squeezing of the trigger 16, spray is emitted from the forward end 43 of the orifice 44 into the foam generating chamber 82 and creates a suction which sucks or educes air through the slots 135 and 136 into the entrance area 80.

At the same time, any foam or liquid (as shown with broken line 148 in FIG. 11) that has dribbled down to the lower side of the second piece 14 and around the rim 144 will be educed or sucked in with air, back into the entrance area 80, such that dripping of liquid is prevented. Note that for this purpose, the dished out area 132 and slots 135 and 136 face downwardly when the assembly 20 is in the FOAM position as shown in FIG. 11.

As a result, the two piece foamer nozzle assembly 20 of the present invention is essentially "drip free".

Although a serrated surface 100 having alternate annular ribs 101 and grooves 102 will work satisfactorily, the height of the ribs 101 or depth of the grooves 102 is limited since one must be able to pull a mold out of the chamber 82 with the ribs 101 being pulled or snapped over ribs on the mold which form the grooves 102. In order to obtain a deeper groove or higher rib, in one embodiment shown in FIG. 12 the mold formation is threaded so that the second outer piece 24 can be unthreaded or unscrewed off of the mold and thereby provide deeper grooves 150 or higher ribs 152.

Figure 12:
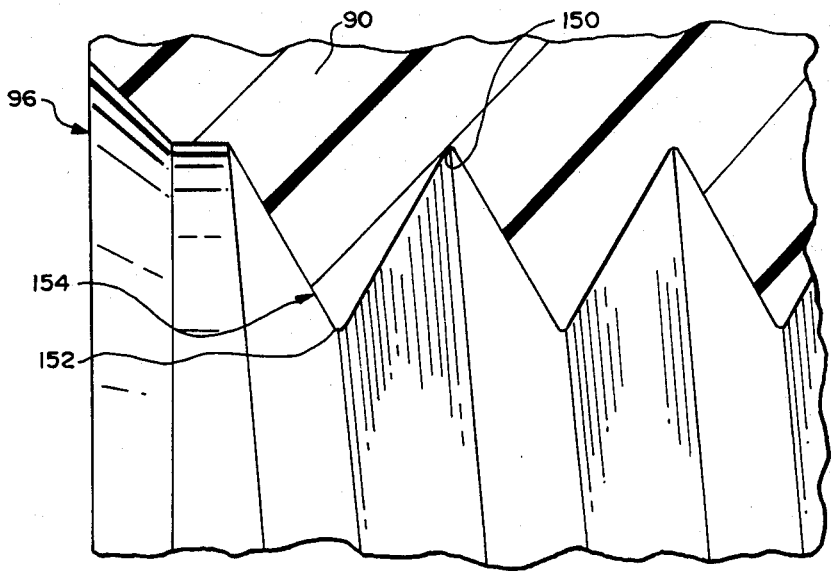
FIG. 12 is a fragmentary sectional view of a modified second outer piece having a threaded interior surface formation within a rearwardly extending cylindrical formation of the second piece instead of a serrated interior surface formation as in the embodiment shown in FIGS. 9 and 10.

As shown in FIG. 12, a foam generating chamber 154 within the cylindrical formation 90 is threaded rather than serrated such that it has a thread ridge 152 and a thread groove 150. The pitch of the thread 152 can be between 0.1 mm and 4 mm per 360° turn and is preferably 1.25 mm per 360° turn.

Furthermore, the height of the threads between the bottom of the groove 150 and the ridge 152 can be between 0.05 mm and 3 mm and is preferably approximately 0.93 mm.

Figure 13:
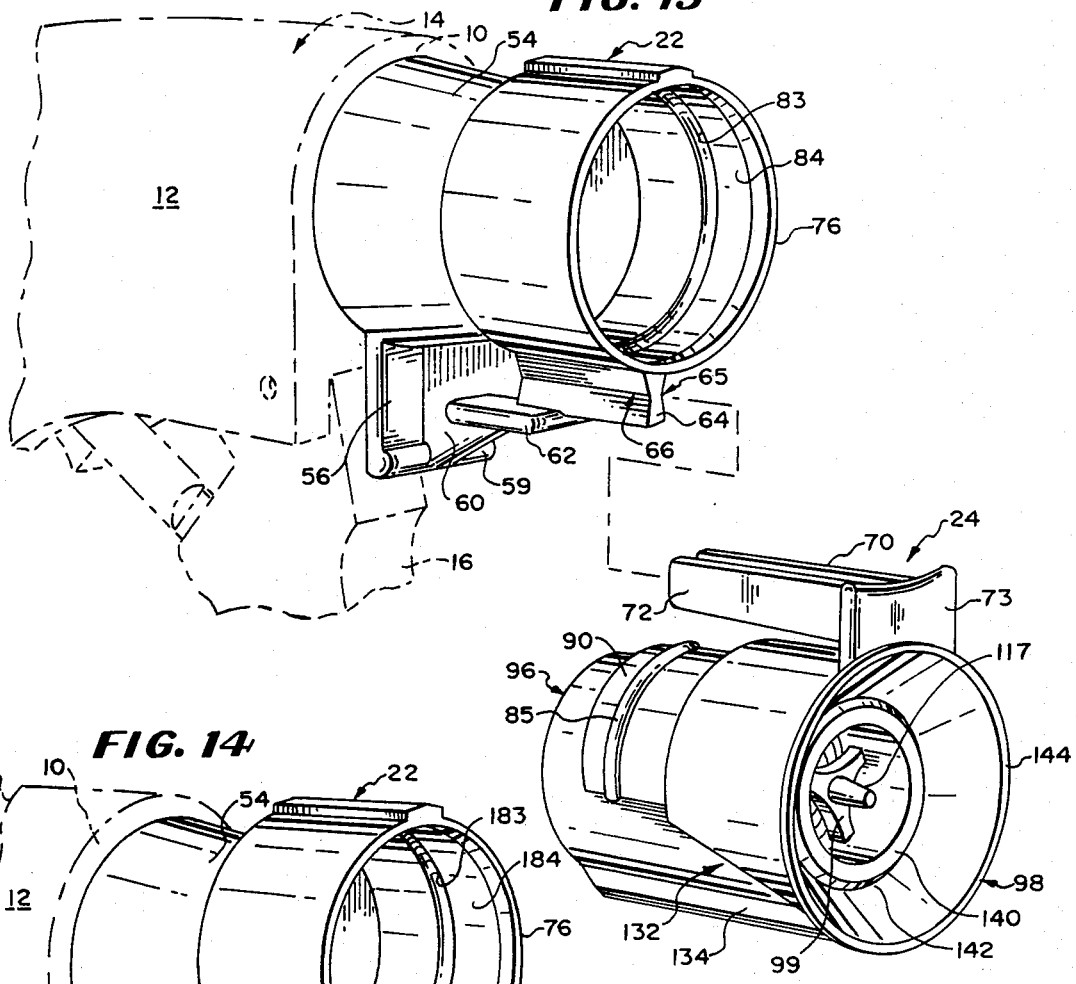
FIG. 13 is am exploded perspective view of the second outer piece separated from the first inner piece and with the outer piece rotated 180° and positioned for attachment beneath the first inner piece.

Referring now to FIGS. 13 and 14, it will be apparent that the fingers 70 and 72 extend axially of the second piece 24 from the tab 73 that extends downwardly from the second outer piece 24 adjacent the nozzle opening 116. When it is desired to remove the outer piece one merely pulls the tab 73 forward so that the annular rib 88 is snapped out of the annular groove 86. Then the second outer piece 24 can be rotated 180°, to the position shown in FIG. 13, and the fingers 70 and 72 can be inserted over the rib 64 and held therein by reason of the mating tongue and groove arrangement (grooves 65,66 and ribs 67,68) and also by the land or ledge 62 which prevents the second piece 24 from being pulled downwardly away from the first piece 22.

From the foregoing description, it will be apparent that the two piece foamer nozzle assembly 20 of the present invention has a number of advantages, some of which have been described above and others of which are inherent in the invention. Also, modifications can be made to the two piece foamer nozzle assembly 20 of the present invention without departing from the teachings of the invention. Accordingly, the scope of the invention is only to be limited as necessitated by the accompanying claims.

I claim:

1. In a trigger sprayer assembly comprising a trigger sprayer having a front end and a nozzle assembly for generating foam, said nozzle assembly being mounted to said front end of said trigger sprayer from which liquid is ejected and comprising structure having an orifice and a foam generating chamber therein positioned so that liquid is emitted from the front end of said trigger sprayer through said orifice in said nozzle assembly structure in a generally conical spray pattern into an entrance end of said foam generating chamber, said nozzle assembly further comprising a front nozzle member having an opening which is in communication with said foam generating chamber such that foam is ejected from said front nozzle opening, the improvement comprising air passage means for supplying air to said entrance end of said foam generating chamber, said air passage means including an enclosed air passageway communicating at one end with said entrance end of said foam generating chamber and opening at the other end adjacent said front nozzle opening and being located so that suction of air into said air passageway also educes foam or liquid, that may tend to drip from said front nozzle opening of said nozzle assembly, into said air passageway and back to said entrance end of said foam generating chamber and into said foam generating chamber as liquid is sprayed into said foam generating chamber.

2. A trigger sprayer having a mounting formation at a front end thereof from which liquid is ejected and comprising a foam generating nozzle assembly including structure having an orifice and a foam generating chamber therein, said nozzle assembly structure being mounted on the formation at the front end of said trigger sprayer so that liquid is emitted from the formation at the front end of the trigger sprayer through said orifice into said foam generating chamber in a generally conical spray pattern, said foam generating chamber having an entrance end into which said spray is directed, and said nozzle assembly also including a front nozzle member having a discharge opening at a front end thereof from which foam is discharged, said discharge opening being in communication with said foam generating chamber whereby foam is ejected forwardly from said foam generating chamber into and then out of said discharge opening, air passage means for supplying air to the entrance end of said foam generating chamber, and having an enclosed air passageway having a first end and a second end, said first end communicating with said air passage means and said second end opening adjacent said front end of said front nozzle member and adjacent said discharge opening at said front end of said front nozzle member.

3. The trigger sprayer of claim 2 wherein said mounting formation is a nozzle bushing at the front end of the trigger sprayer, and said structure that has an orifice therein comprises a nozzle cap rotatably mounted on said nozzle bushing, and said nozzle cap and said bushing having cooperating passage means which are in registration with each other at a selected rotated foam generating position of said nozzle cap on the nozzle bushing and wherein said foam generating chamber is located in said nozzle cap and has an annular side wall against which said conical spray pattern impinges to form foam when said nozzle cap is rotated about the nozzle bushing from a closed position to a foam generating position followed by actuation of the trigger sprayer, and a pin is axially fixed in a position in said nozzle assembly at a location spaced from the front end of said orifice and has a rounded, radially diverging, end portion for radially deflecting, outwardly against said side wall of said foam generating chamber, droplets of liquid that exit said orifice generally axially and impinge upon said end portion of said pin.

4. The trigger sprayer of claim 2 wherein said mounting formation is a nozzle bushing located at the front end of the trigger sprayer, wherein said foam generating chamber conical spray pattern is caused to impinge upon said side wall of said foam generating chamber, and wherein said air passage means is unobstructed at, and opening completely around, said entrance end of said foam generating chamber for supplying air to said foam generating chamber from said air passageway completely around said entrance end of said foam generating chamber.

5. The trigger sprayer of claim 2 wherein said foam generating chamber is annular and has an annular interior surface which is a fixed in position serrated surface extending the full length of said annular chamber for causing turbulence in the sprayed liquid impinging thereon to facilitate mixing of air with the liquid sprayed therein to generate foam.

6. The trigger sprayer of claim 2 wherein said foam generating chamber is annular and has an annular interior surface which is a fixed in position threaded surface extending the full length of said annular chamber for causing turbulance in a sprayed liquid impinging thereon to facilitate mixing of air with the liquid sprayed therein to generate foam.

7. The trigger sprayer of claim 2 wherein the mounting formation is a nozzle bushing located at the front end of the trigger sprayer and wherein said nozzle assembly includes a first inner piece rotatably mounted to the nozzle bushing and having an outer cavity, and a separate second outer piece having said foam generating chamber in a formation thereof which is adapted to be received in said outer cavity in said first inner piece when said second piece is connected to said first piece in a first connected position, said second outer piece being completely releasable from said first inner piece, said first inner piece having connecting means thereon, and said second outer piece having cooperating connecting means for releasably attaching said second outer piece to said connecting means of said first inner piece in a non-foam generating second connected position whereby liquid can be sprayed from said first piece in a spray pattern out of said outer cavity when said second piece is releasably attached to said first inner piece in said non-foam generating second connected position and readily available for connection to said first piece in said first connected position for foam generation.

8. The trigger sprayer of claim 2 wherein said second end of said air passageway is located so that suction of air into said air passageway also educes drips of foam, that may tend to drip from said discharge opening, by the sucking of such foam into said air passageway back to said air passage means at the entrance end of said foam generating chamber as liquid is sprayed into said foam generating chamber.

9. A foam generating nozzle assembly for mounting onto a nozzle bushing at the front end of a trigger sprayer, said nozzle assembly comprising a first inner piece which is rotatably mounted to the nozzle bushing, which has an outer cavity and which has an orifice in said first inner piece opening into said outer cavity, and a separate second outer piece having a foam generating chamber in formation thereof which is adapted to be received in said outer cavity in said first inner piece when said second piece is connected to said first piece in a first connected position, said second outer piece being completely releasable from said first inner piece, said first inner piece having connecting means thereon, and said second outer piece having cooperating connecting means for releasably attaching said second outer piece to said connecting means of said first inner piece in a non-foam generating second connected position whereby liquid can be sprayed from said first piece in a spray pattern out of said outer cavity when said second piece is releasably attached to said first inner piece in said non-foam generating second connected position and readily available for connection to said first piece in said first connected position for foam generation.

* * * * *